US011608681B2

(12) United States Patent
Grife

(10) Patent No.: US 11,608,681 B2
(45) Date of Patent: Mar. 21, 2023

(54) VALANCE ASSEMBLY

(71) Applicant: Lippert Components, Inc., Elkhart, IN (US)

(72) Inventor: Barry Grife, Placida, FL (US)

(73) Assignee: LIPPERT COMPONENTS, INC., Elkhart, IN (US)

( * ) Notice: Subject to any disclaimer, the term of this patent is extended or adjusted under 35 U.S.C. 154(b) by 93 days.

(21) Appl. No.: 16/794,501

(22) Filed: Feb. 19, 2020

(65) Prior Publication Data

US 2020/0270941 A1 Aug. 27, 2020

Related U.S. Application Data

(60) Provisional application No. 62/809,808, filed on Feb. 25, 2019.

(51) Int. Cl.
*E06B 9/58* (2006.01)
*E06B 9/40* (2006.01)
*E06B 9/266* (2006.01)

(52) U.S. Cl.
CPC ..... *E06B 9/58* (2013.01); *E06B 9/266* (2013.01); *E06B 9/40* (2013.01)

(58) Field of Classification Search
CPC ... E06B 9/56; E06B 9/266; E06B 9/40; E06B 9/42; E06B 9/264; E06B 9/323; E06B 2009/587; A47H 1/13; Y10T 24/44026
See application file for complete search history.

(56) References Cited

U.S. PATENT DOCUMENTS 4,254,813 A * 3/1981 Vecchiarelli ..... A47H 2/00 160/19
5,074,353 A * 12/1991 Ohno ..... B22D 11/143 164/122.1
5,205,334 A * 4/1993 Judkins ..... E06B 9/174 160/89
6,039,295 A * 3/2000 de Beijer ..... A47H 1/144 160/178.1 R
2003/0173036 A1* 9/2003 Kwon ..... E06B 9/264 160/107
2008/0169067 A1* 7/2008 Zhang ..... E06B 9/266 160/38
2009/0057512 A1* 3/2009 Garmyn ..... E06B 9/58 248/220.21

(Continued)

*Primary Examiner* — Johnnie A. Shablack
*Assistant Examiner* — Matthew R. Shepherd
(74) *Attorney, Agent, or Firm* — Nixon & Vanderhye P.C.

(57) ABSTRACT

A valance kit and mounting assembly secure a valance adjacent a window frame. A mounting block is securable in a clamp ring cavity of the window frame and includes a snap connector on the frame side thereof and a valance groove in each of the top and bottom sides thereof. The valance grooves extend in a width direction across the mounting block and have a depth dimension parallel with a plane of the window opening. A valance assembly includes a plurality of shrouds that together define the valance. Each of the shrouds is provided with a pair of snap ridges disposed facing each other and spaced substantially corresponding to a space between the top and bottom sides of the mounting block. The snap ridges are sized and positioned to engage the valance grooves in a snap fit. The universal mounting block is suitable for mounting various types of window treatments.

9 Claims, 11 Drawing Sheets

(56) References Cited

U.S. PATENT DOCUMENTS

| | | | | |
|---|---|---|---|---|
| 2011/0005153 | A1* | 1/2011 | Schield | E06B 1/68 52/204.53 |
| 2012/0012262 | A1* | 1/2012 | Santoro | E06B 9/582 160/271 |
| 2012/0291963 | A1* | 11/2012 | Marocco | E06B 9/40 160/120 |
| 2015/0292258 | A1* | 10/2015 | Pellini | B32B 27/08 428/34 |
| 2017/0211315 | A1* | 7/2017 | Fleischman | E06B 9/174 |
| 2020/0018117 | A1 | 1/2020 | Grife | |

* cited by examiner

VALANCE ASSEMBLY

CROSS-REFERENCES TO RELATED APPLICATIONS

This application claims the benefit of U.S. Provisional Patent Application No. 62/809,808, filed Feb. 25, 2019, the entire content of which is herein incorporated by reference.

STATEMENT REGARDING FEDERALLY SPONSORED RESEARCH OR DEVELOPMENT (NOT APPLICABLE)

BACKGROUND

The invention relates to a valance assembly secured adjacent a window frame positioned in a window opening and, more particularly, to a valance kit and mounting assembly including a universal mounting block for securing the valance.

It is desirable in many environments to add window treatments to windows for aesthetic reasons and/or for privacy shades or blinds. Various types of window treatments exist, including roller shades, pleated shades, mini-blinds, etc. Typically, mounting the various window treatments requires different hardware and the like for each treatment type.

A valance assembly can be added to a window treatment to cover unsightly brackets and the like and to provide an overall improved appearance of the window. Existing valance assemblies, however, are not easily mounted and include numerous parts that add to production costs.

BRIEF SUMMARY

It is thus an object of the invention to provide a universal mounting block that is readily securable to a window frame and is adaptable to various window treatment types. Moreover, a valance assembly includes a plurality of shrouds that are securable to the mounting block and may additionally support and/or guide components of the window treatment.

In an exemplary embodiment, a valance kit and mounting assembly secures a valance adjacent a window frame positioned in a window opening and has a clamp ring cavity. The valance kit and mounting assembly includes a mounting block securable in the clamp ring cavity of the window frame. The mounting block has a frame side, an outer side opposite from the frame side, and top and bottom sides. The mounting block includes a snap connector on the frame side thereof and a valance groove in each of the top and bottom sides. The valance grooves extend in a width direction across the mounting block and have a depth dimension parallel with a plane of the window opening. A valance assembly includes a plurality of shrouds that together define the valance, where each of the shrouds has a pair of snap ridges disposed facing each other and spaced substantially corresponding to a space between the top and bottom sides of the mounting block. The snap ridges are sized and positioned to engage the valance grooves in a snap fit.

The plurality of shrouds may include a pair of side shrouds, a top shroud, a bottom shroud, and valance corners connected between the side shrouds and the top and bottom shrouds, where the valance kit and mounting assembly may include at least one mounting block for each of the plurality of shrouds. The valance kit and mounting assembly may include two mounting blocks for each of the top and bottom shrouds and three mounting blocks for each of the side shrouds.

The valance grooves may be defined by posts respectively extending from the top and bottom sides of the mounting block, where the posts adjacent the outer side of the mounting block may be angled to define a cam surface. The posts may be staggered across the width direction of the mounting block. The assembly may include three of the posts adjacent the outer side of the mounting block on each of the top and bottom sides of the mounting block and two of the posts adjacent the frame side of the mounting block on each of the top and bottom sides of the mounting block.

The mounting block may further include a roller shade connector on the outer side thereof. The plurality of shrouds may include a top shroud positionable over a roller shade secured to the roller shade connector, where the top shroud has a shade guide that is positioned to engage the roller shade. The plurality of shrouds may include side shrouds, where the side shrouds may include a shade track extending along a length dimension thereof that is sized to receive ends of the roller shade.

The plurality of shrouds may include a top shroud, where the top shroud has a cavity that is sized and configured to support a pleated shade or a mini-blind. The plurality of shrouds may further include side shrouds connected to the top shroud, and the side shrouds may include a shade track extending along a length dimension thereof that is sized to guide ends of the pleated shade or mini-blind.

In another exemplary embodiment, a valance kit and mounting assembly includes a mounting block securable in the clamp ring cavity of the window frame, where the mounting block has a frame side, an outer side opposite from the frame side, and top and bottom sides. The mounting block has a snap connector on the frame side thereof, a valance groove in each of the top and bottom sides, and a roller shade connector on the outer side. The valance grooves extend in a width direction across the mounting block and have a depth dimension parallel with a plane of the window opening. The assembly also includes a valance assembly with a plurality of shrouds that together define the valance, where each of the shrouds has a pair of snap ridges disposed facing each other and spaced substantially corresponding to a space between the top and bottom sides of the mounting block. The snap ridges are sized and positioned to engage the valance grooves in a snap fit. The plurality of shrouds include a top shroud having a cavity that is sized and configured to support a pleated shade or a mini-blind.

BRIEF DESCRIPTION OF THE DRAWINGS

These and other aspects and advantages will be described in detail with reference to the accompanying drawings, in which.

DETAILED DESCRIPTION

Figure 1A:
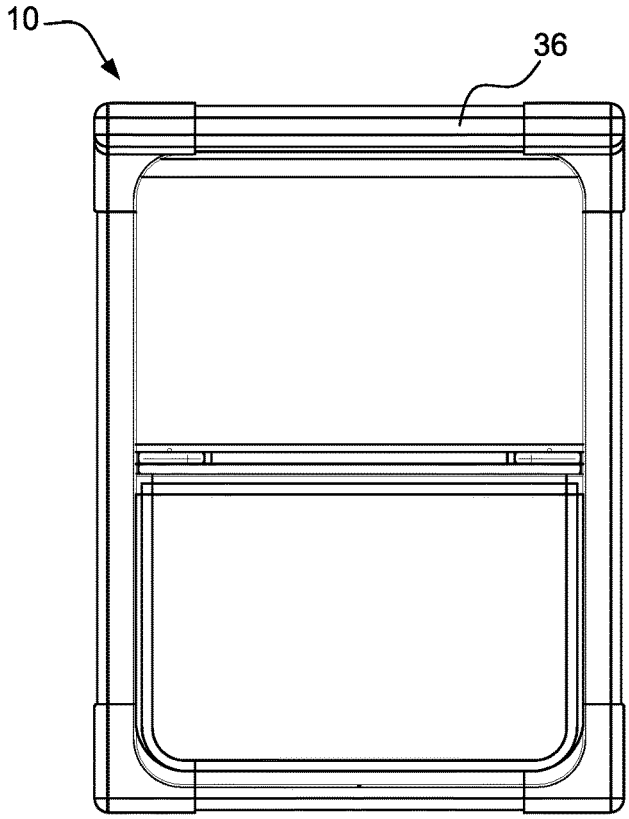
FIGS. 1A-1C show an application of the valance kit and mounting assembly of the described embodiments in a roller shade application.
Figure 1B:
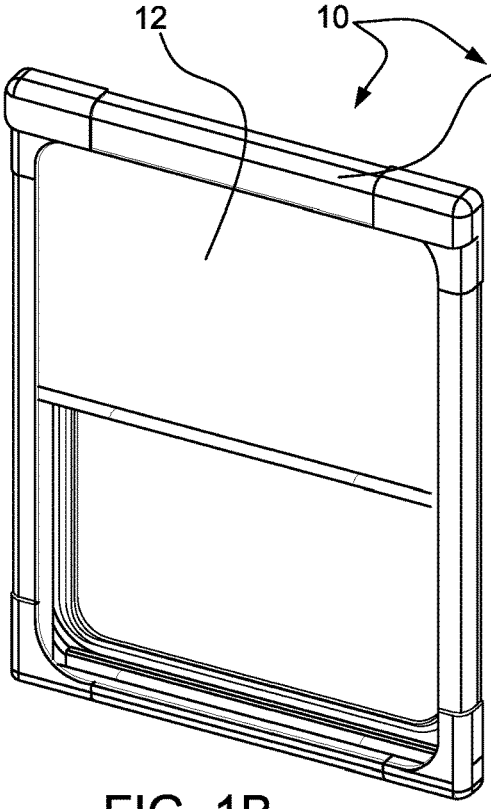
Figure 1C:
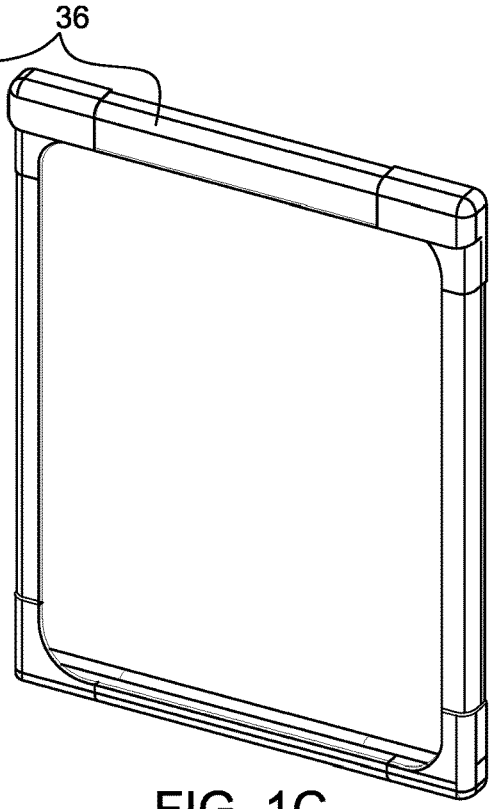
Figure 2:
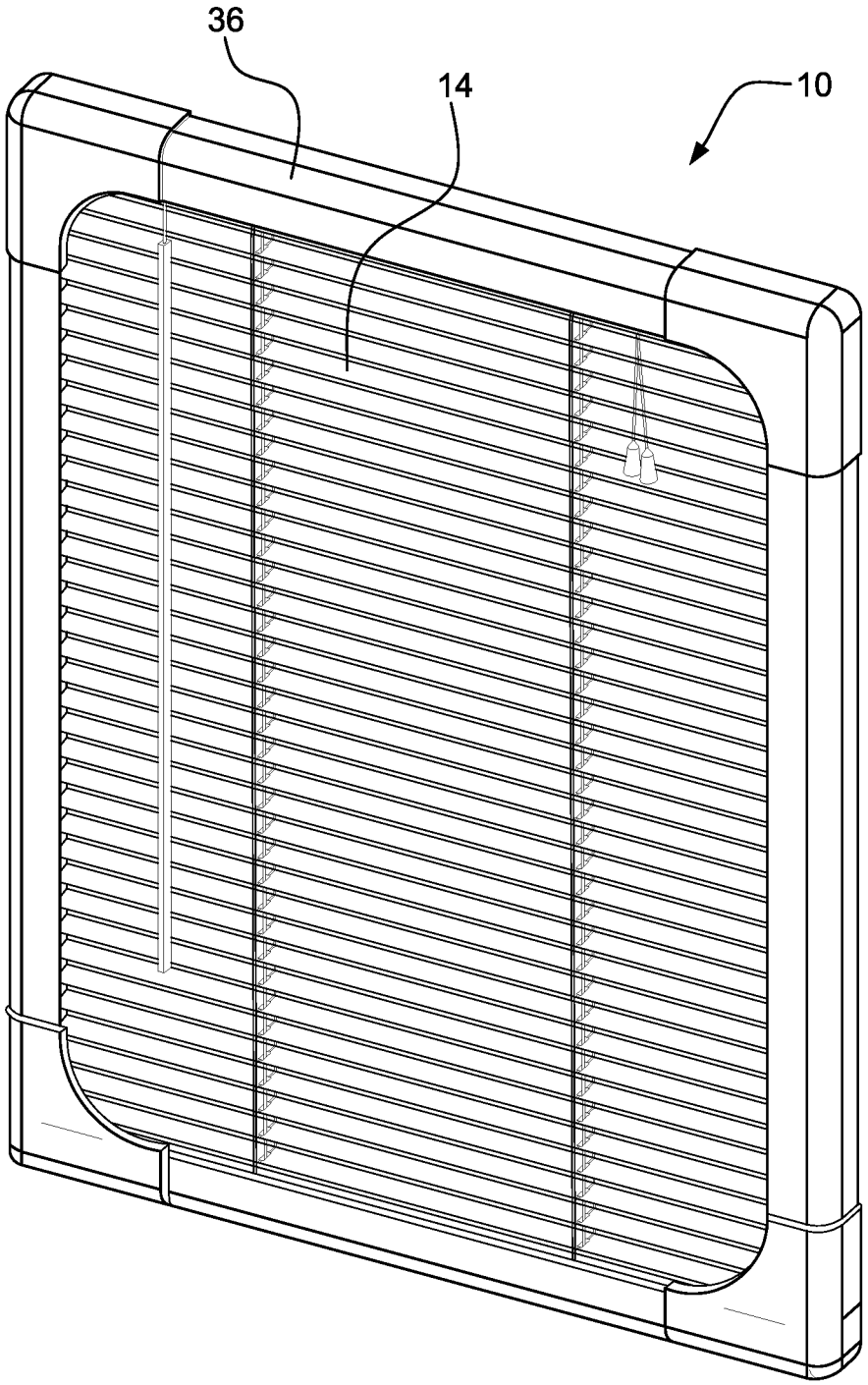
FIG. 2 shows the valance kit and mounting assembly in a mini-blind application.
Figure 3:
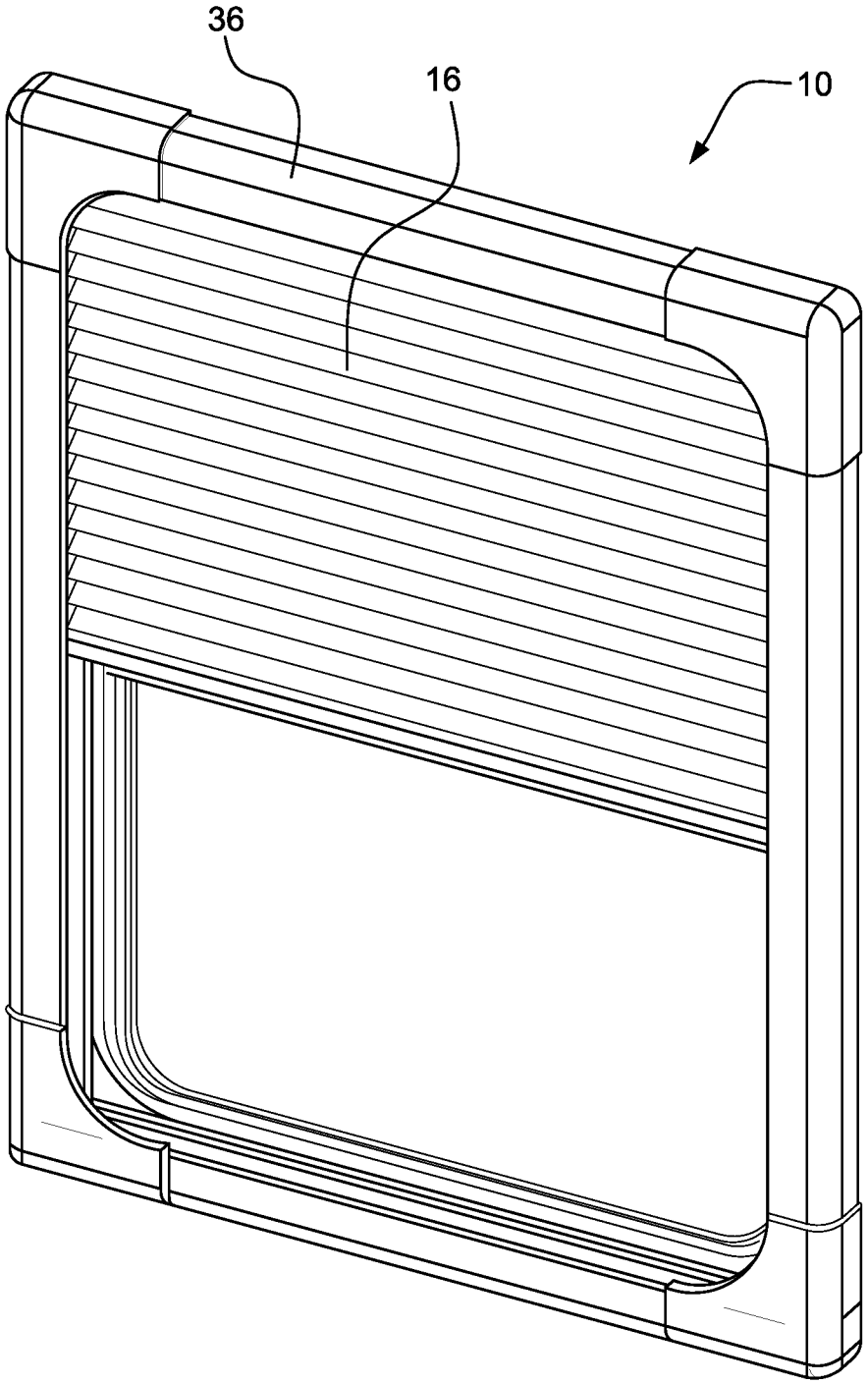
FIG. 3 shows the valance kit and mounting assembly in a pleated blind application.

FIGS. 1A-1C show a valance kit and mounting assembly 10 incorporating a roller blind 12. FIG. 2 shows the valance kit and mounting assembly 10 incorporating a mini-blind 14, and FIG. 3 shows the valance kit and mounting assembly 10 incorporating a pleated blind 16.

Figure 4:
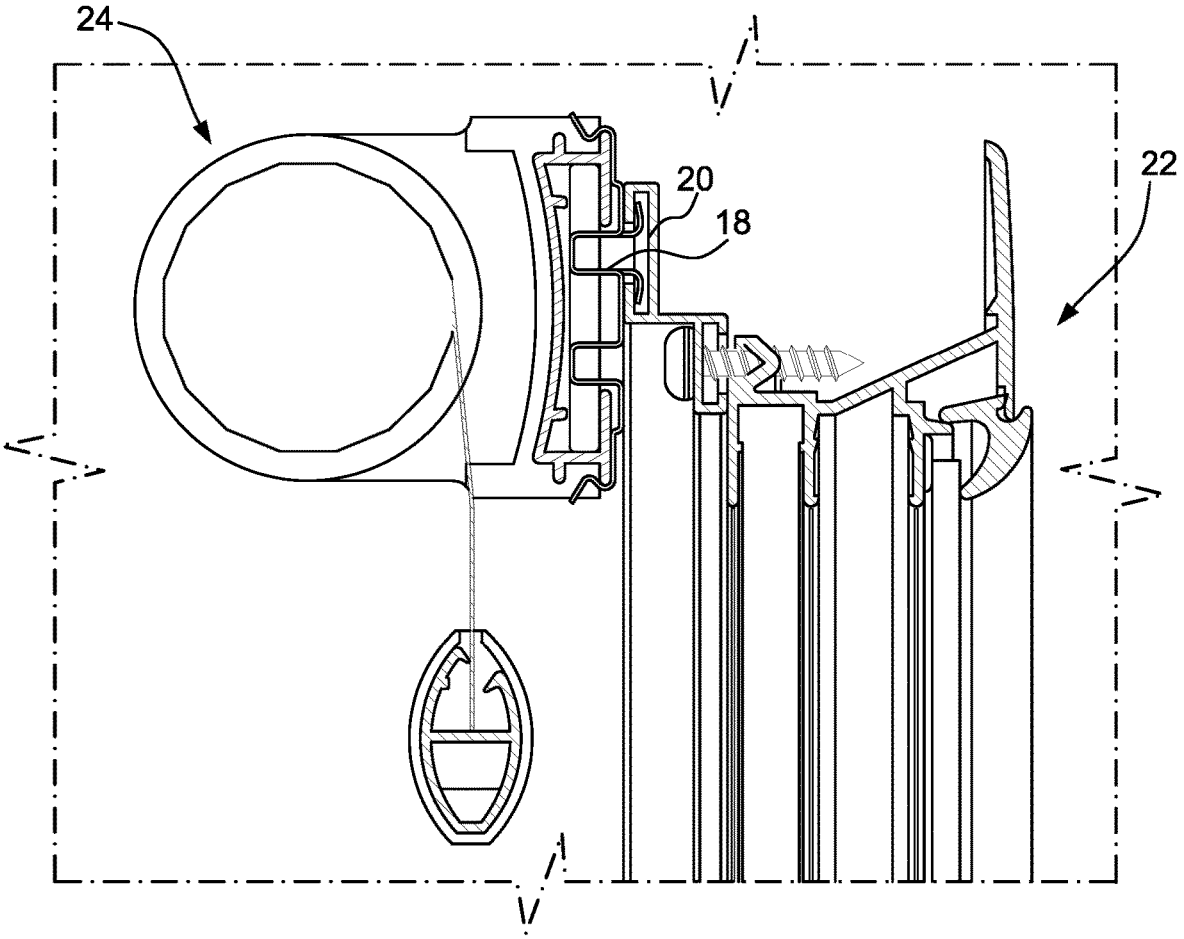
FIG. 4 (PRIOR ART)
FIG. 4 is a side sectional view of an existing spring clip attachable to a window frame and supporting the roller blind assembly.

FIG. 4 shows an existing configuration utilizing a spring clip 18 securable in a clamp ring cavity 20 of a window frame 22. The spring clip 18 is designed to be inserted into the clamp ring cavity 20 and turned 90° to lock the clip 18 in place. A roller shade assembly 24 is installed by snapping into protrusions of the spring clip 18. As noted above, it would be desirable to modify this mounting structure to accommodate alternatives to the roller shade assembly 24 and also to support a valance.

Figure 5:
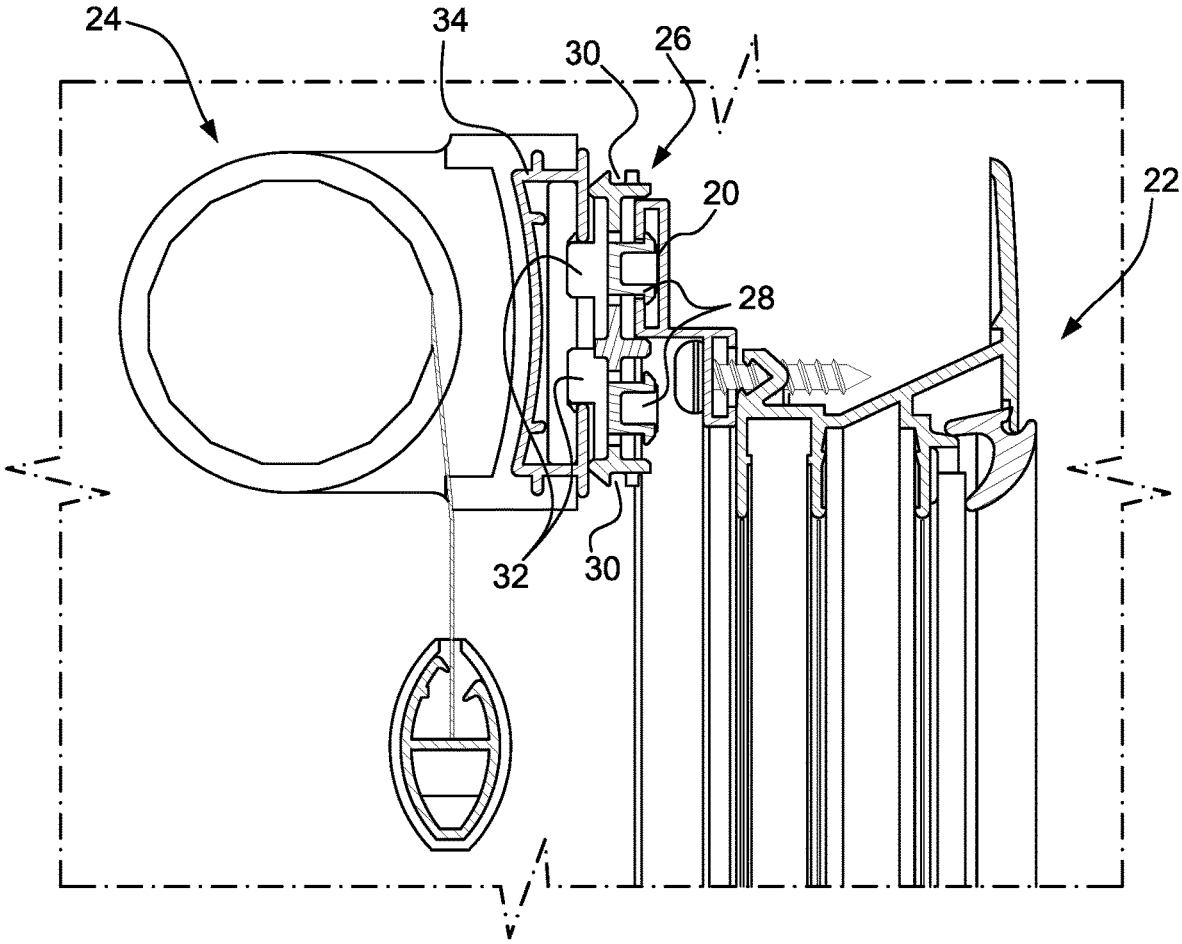
FIG. 5 shows a roller blind assembly secured to a universal mounting block according to the described embodiments.
Figure 5A:
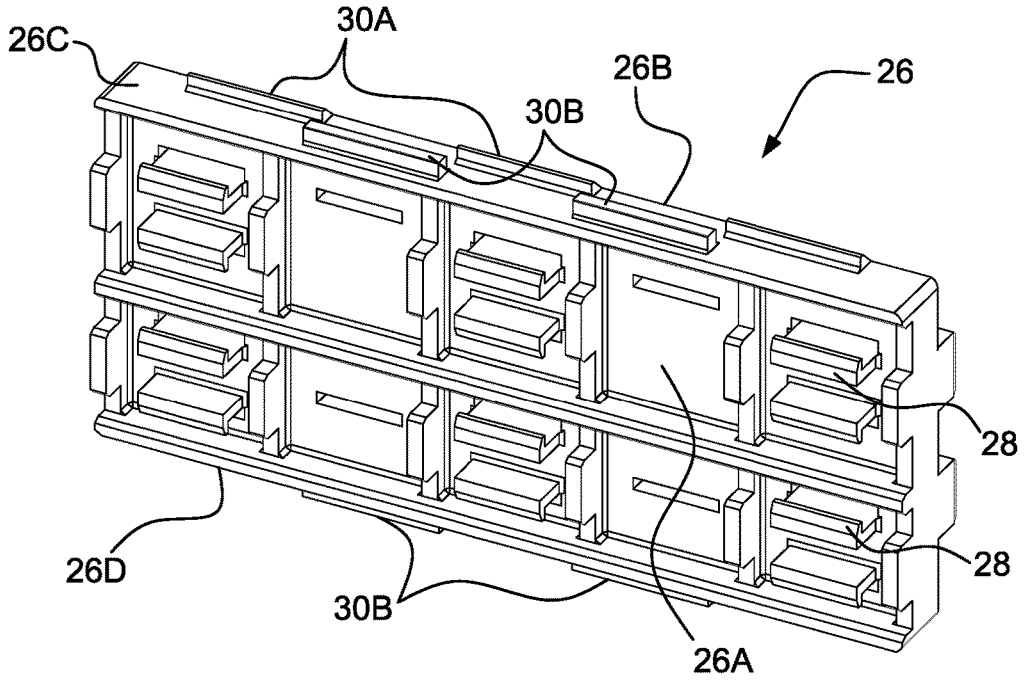
FIG. 5A is a perspective view of the universal mounting block.

FIGS. 5 and 5A show a universal mounting block 26 that is securable in the clamp ring cavity 20 of the window frame 22. The mounting block has a frame side 26A (i.e., the side of the block 26 that faces the window frame 22), an outer side 26B opposite from the frame side 26A, a top side 26C and a bottom side 26D. As shown, the mounting block 26 includes a snap connector 28 on the frame side 26A and a valance groove 30 in each of the top and bottom sides 26C, 26D. The valance grooves 30 extend in a width direction across the mounting block 26 and have a depth dimension parallel with a plane of the window opening.

With continued reference to FIG. 5A, the valance grooves 30 are defined by posts 30A, 30B respectively extending from the top and bottom sides of the mounting block 26. The posts 30A adjacent the outer side 26B of the mounting block 26 are angled to define a cam surface. In some embodiments, the posts 30A, 30B are staggered across the width direction of the mounting block 26. In the exemplary configuration shown in FIG. 5A, the mounting block 26 includes three of the posts 30A adjacent the outer side 26B of the mounting block 26 on each of the top 26C and bottom 26D sides of the mounting block 26, and two of the posts 30B adjacent the frame side 26A of the mounting block 26 on each of the top 26C and bottom 26D sides of the mounting block 26.

The mounting block 26 is also provided with one or more roller shade connectors 32 on the outer side 26B of the mounting block 26. The roller shade connectors 32 are configured to receive an elongated beam 34, which forms part of the roller shade assembly 24. The construction of the roller shade assembly 24 including the elongated beam 34 is the subject of U.S. patent application Ser. No. 16/507,408 filed Jul. 10, 2019, the contents of which are hereby incorporated by reference.

Figure 6:
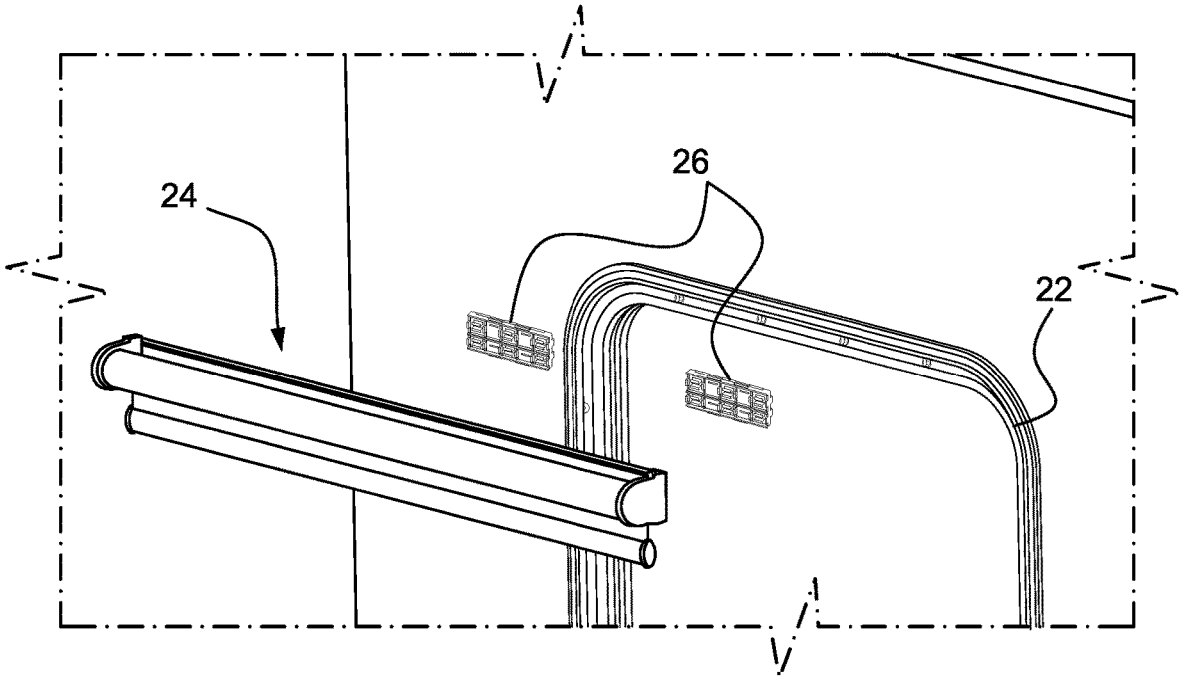
FIG. 6 is an exploded view showing the universal mounting blocks supporting the roller blind assembly.

FIG. 6 is an exploded view showing the use of two of the universal mounting blocks 26 for securing the roller shade assembly 24 to the window frame 22.

Referring again to FIGS. 1A-1C, 2 and 3, the valance kit and mounting assembly 10 is also provided with a valance assembly 36. The valance assembly 36 serves as a decorative cover for the window frame 22 and also conceals the connecting components for the window treatment. Additionally, as described in more detail below, the valance assembly 36 may be provided with structure for supporting and/or guiding portions of the window treatment.

Figure 10:
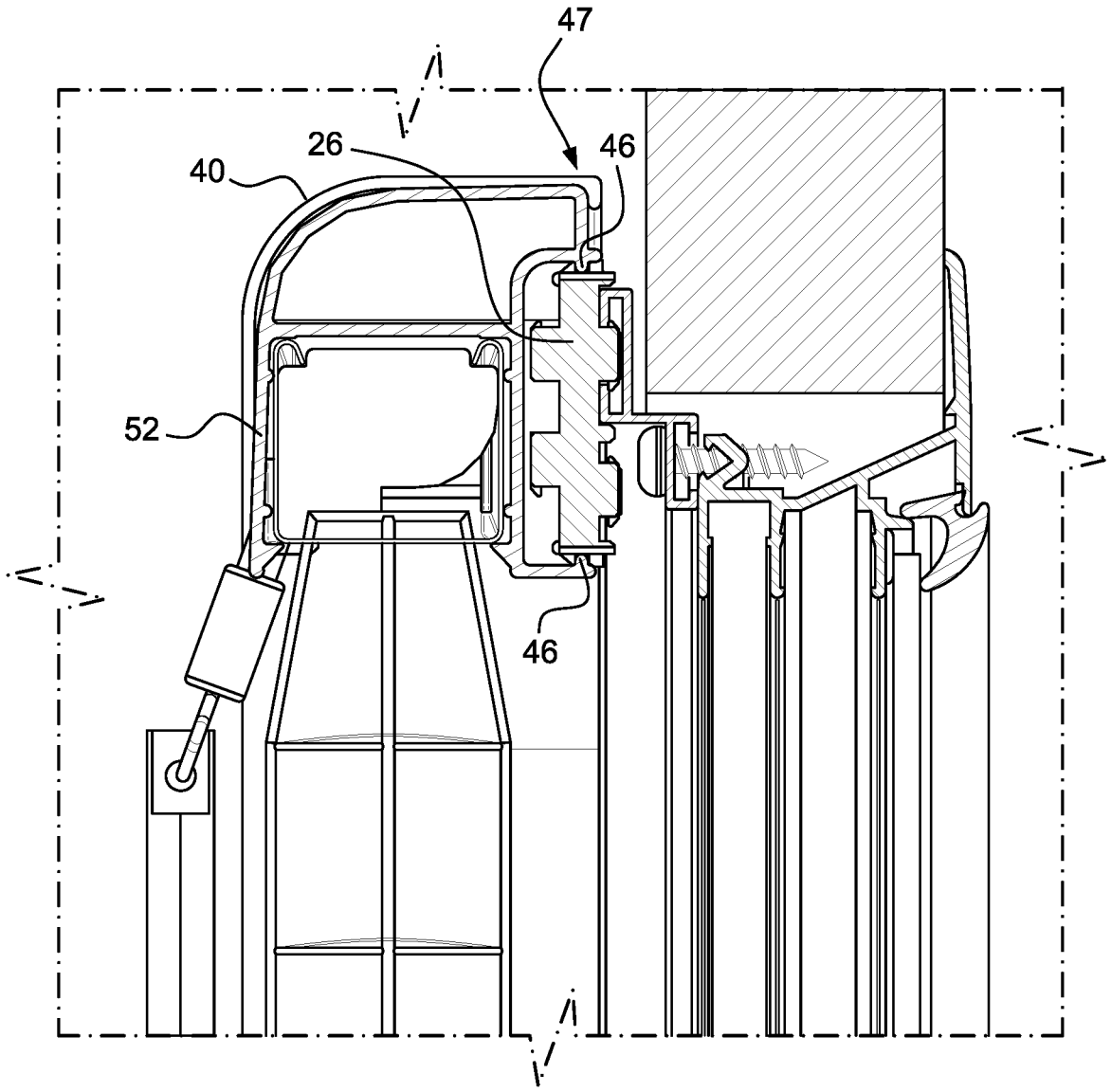
FIG. 10 is a side sectional view showing the mini-blind application.
Figure 11:
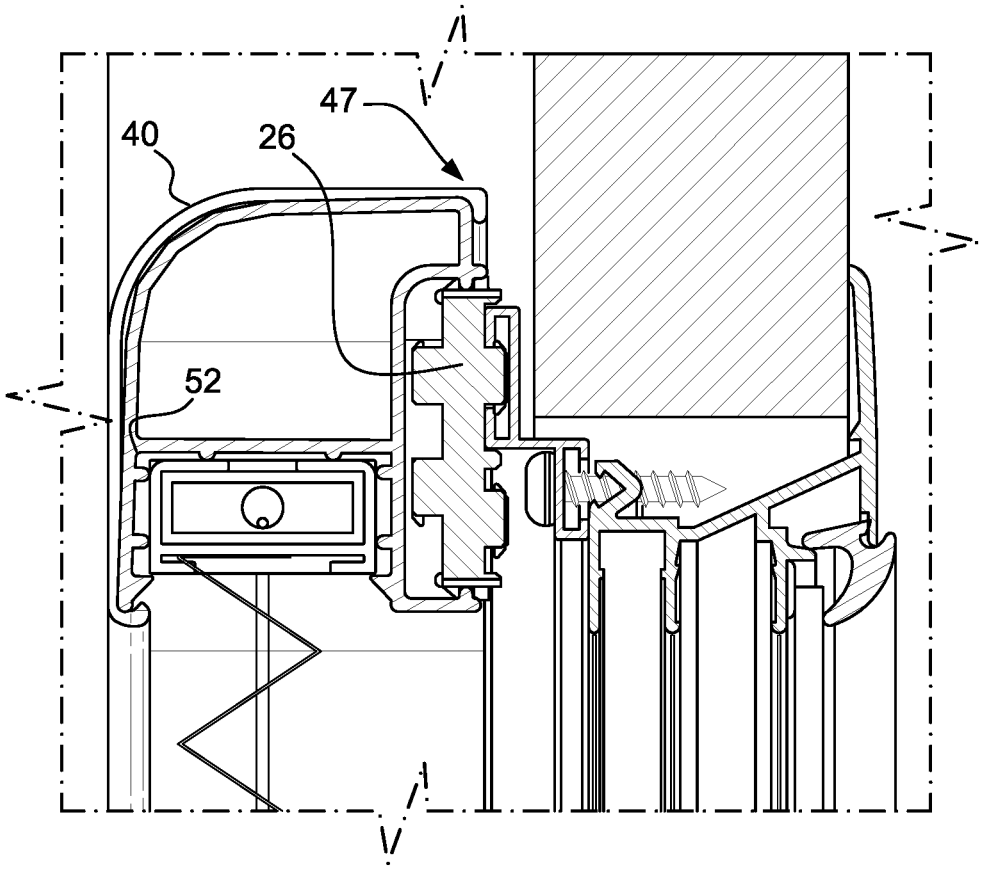
FIG. 11 is a side sectional view showing the pleated blind application.

Generally, the valance assembly 36 is made up of a plurality of shrouds that together define the valance. Specifically, with reference to FIG. 7, the plurality of shrouds that define the valance may include a pair of side shrouds 38, a top shroud 40, a bottom shroud 42, and valance corners 44. Each of the shrouds may be provided with a pair of snap ridges 46 (one shown in FIG. 8) (see also FIG. 10) that are disposed facing each other and spaced substantially corresponding to a space between the top and bottom sides 26C, 26D of the mounting block 26. The snap ridges 46 are sized and positioned to engage the valance grooves 30 in a snap fit. That is, as the shrouds 38, 40, 42 are pressed into engagement with the universal mounting blocks 26, the snap ridges 46 engage the inclined surfaces of the forward post 30A, which deflect the snap ridges outwardly until the snap ridges clear the inclined surface. After which, the snap ridges 46 return to an undeflected state engaged in the valance grooves 30. As shown in FIGS. 10 and 11, corners of the shrouds (top shroud 40 shown in FIGS. 10 and 11) may include a hook component 47 at the outer edges of the corners as shown to better secure the corners.

Figure 7:
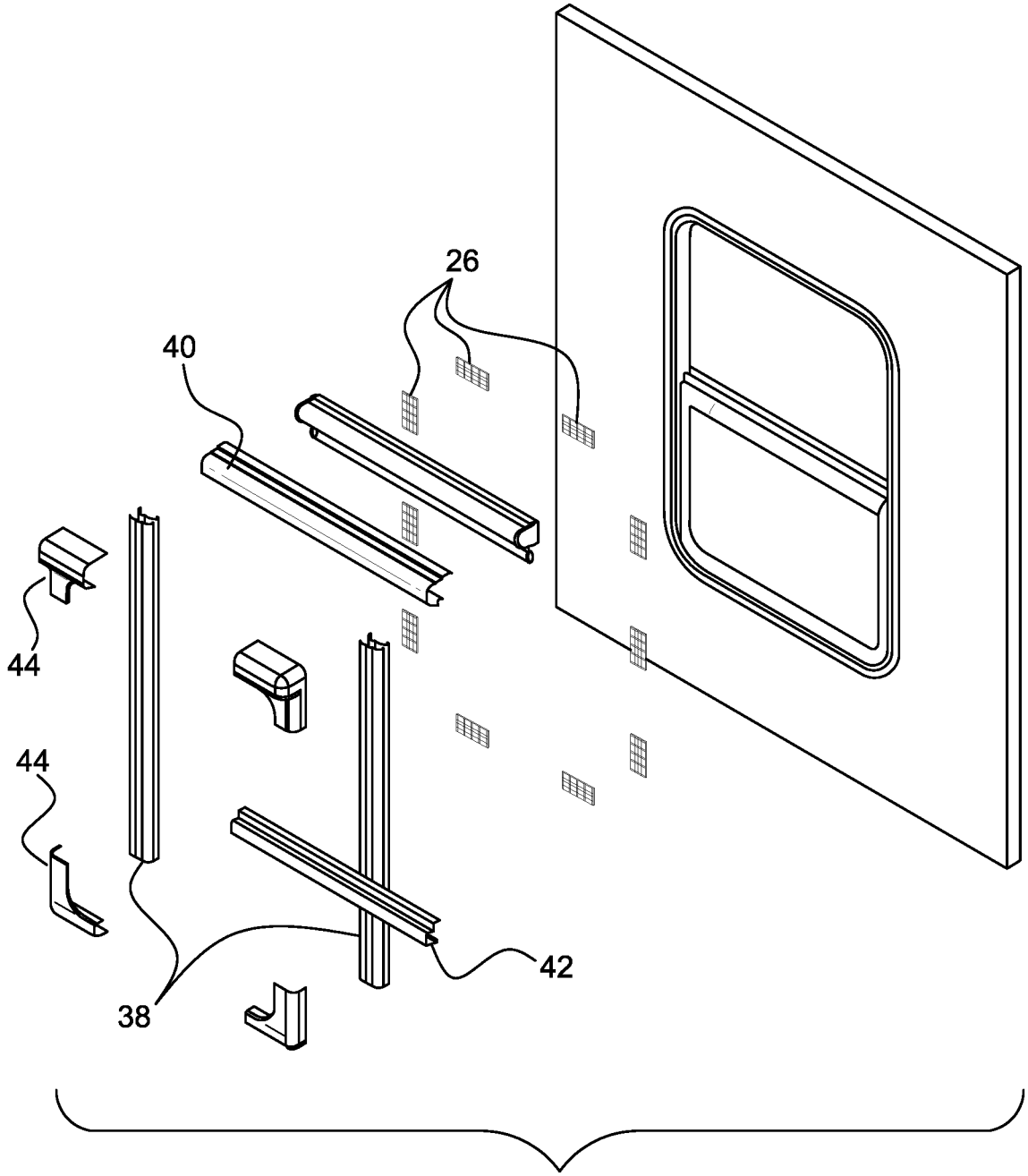
FIG. 7 is an exploded perspective view showing all of the components of the valance kit and mounting assembly with the roller blind application.

With continued reference to FIG. 7, at least one mounting block 26 is provided for each of the plurality of shrouds 38, 40, 42. In the exemplary construction shown in FIG. 7, there are two mounting blocks 26 for each of the top 40 and bottom 42 shrouds and three mounting blocks 26 for each of the side shrouds 38.

Figure 8:
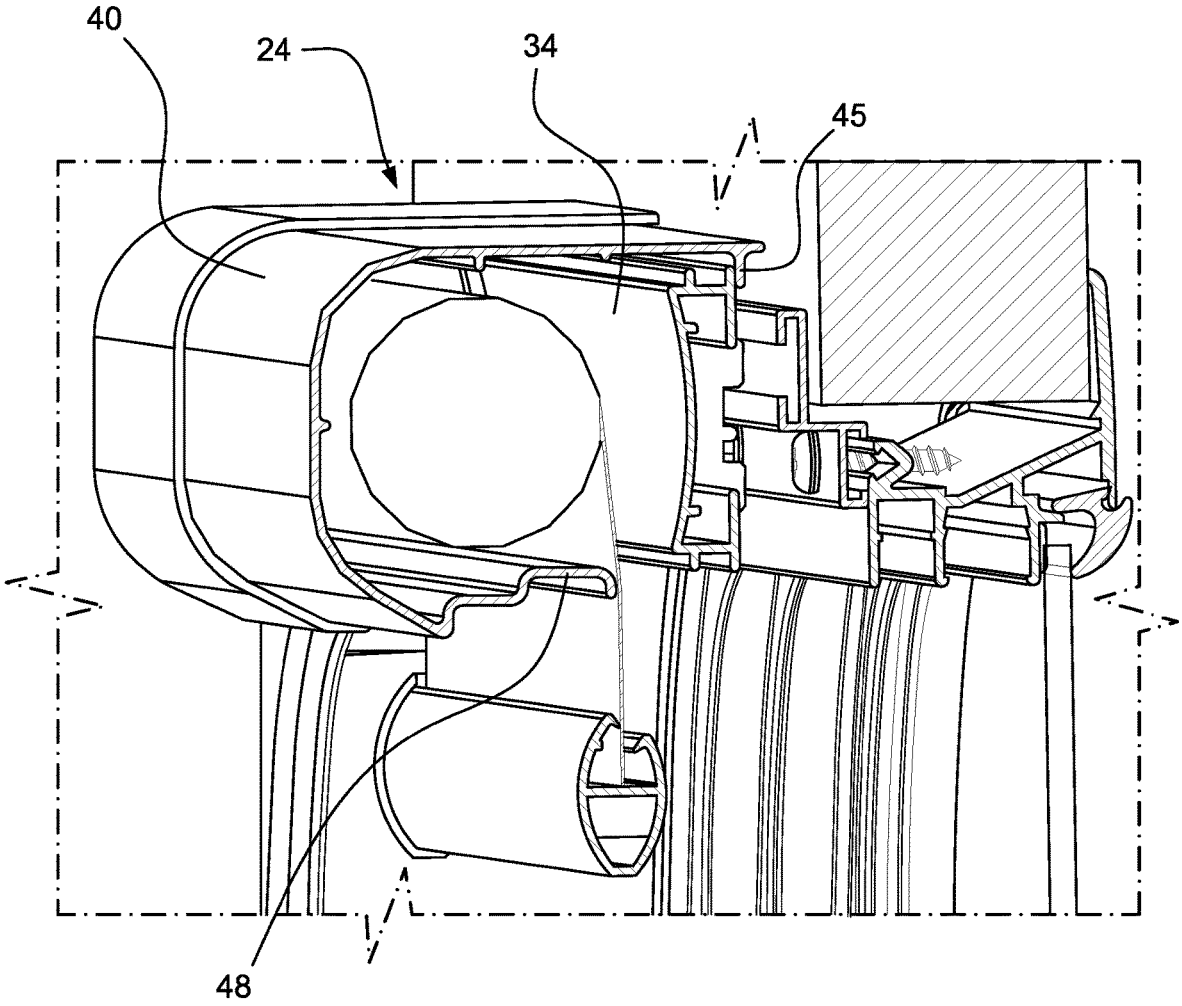
FIG. 8 is a sectional perspective view showing a shade guide built into the valance shroud.
Figure 9:
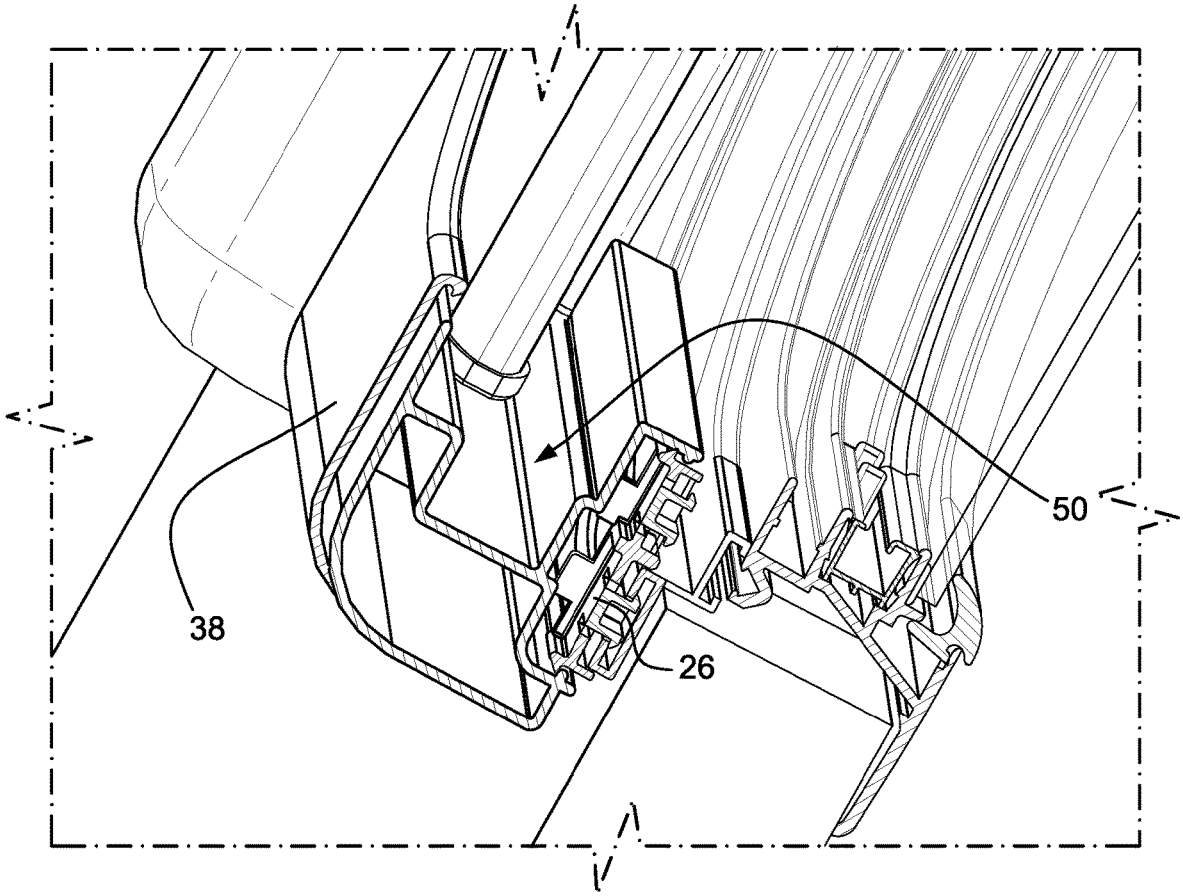
FIG. 9 is a sectional perspective view through a side shroud of the valance assembly.

FIG. 8 shows a roller blind application where the top shroud 40 is positionable over the roller shade assembly 24. The top shroud 40 includes a ridge 45 that is fit over the elongated beam 34. The top shroud 40 may be provided with a shade guide 48 that is positioned to engage the roller shade assembly as shown. The shade guide 48 serves to keep the shade on an even plane when the shade is being rolled out. With reference to FIG. 9, the side shrouds 38 may also be provided with a shade track 50 extending along a length dimension of the side shrouds 38. The shade track 50 is sized to receive ends of the roller shade.

FIG. 10 shows an application supporting a mini-blind, and FIG. 11 shows a related application supporting a pleated shade. In these applications, the top shroud 40 is provided with a cavity 52 that is sized and configured to support the mini-blind or pleated shade. The shade track 50 in the side shrouds 38 may serve to guide ends of the mini-blind or pleated shade.

The universal mounting block provides a single mounting structure for supporting various window treatments. Additionally, at least the side shrouds may be configured to support and/or guide the various window treatments. As a consequence, in addition to facilitating assembly, manufacturing costs can be reduced.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A valance kit and mounting assembly for securing a valance adjacent a window frame positioned in a window opening and having a clamp ring cavity, the valance kit and mounting assembly comprising:

a mounting block securable in the clamp ring cavity of the window frame, the mounting block having a frame side, an outer side opposite from the frame side, and top and bottom sides, the mounting block including a snap connector protruding from the frame side thereof and a valance groove extending across each of the top and bottom sides, wherein the snap connector comprises deflectable legs with respective cam surfaces and is configured to engage the clamp ring cavity in a snap fit, and wherein the valance grooves extend in a width direction across the mounting block and have a depth dimension parallel with a plane of the window opening; and a valance assembly including a plurality of shrouds that together define the valance, each of the shrouds including a pair of snap ridges disposed facing each other and spaced substantially corresponding to a space between the top and bottom sides of the mounting block, wherein when one of the plurality of shrouds is secured to the mounting block, the pair of snap ridges of the one of the plurality of shrouds engage the valance grooves in a snap fit, wherein the valance grooves are defined between opposing posts respectively extending from the top and bottom sides of the mounting block, wherein posts of the opposing posts that are adjacent the outer side of the mounting block are angled to define a cam surface, wherein the opposing posts extending from the top of the mounting block are staggered across the width direction of the mounting block with the snap ridges of the one of the plurality of shrouds positioned between the opposing posts when the one of the plurality of shrouds is secured to the mounting block, and wherein the opposing posts extending from the bottom of the mounting block are staggered across the width direction of the mounting block with the snap ridges of the one of the plurality of shrouds positioned between the opposing posts when the one of the plurality of shrouds is secured to the mounting block.

2. A valance kit and mounting assembly according to claim 1, wherein the plurality of shrouds comprise a pair of side shrouds, a top shroud, a bottom shroud, and valance corners connected between the side shrouds and the top and bottom shrouds, the valance kit and mounting assembly comprising at least one mounting block for each of the plurality of shrouds.

3. A valance kit and mounting assembly according to claim 2, comprising two mounting blocks for each of the top and bottom shrouds and three mounting blocks for each of the side shrouds.

4. A valance kit and mounting assembly according to claim 1, comprising three of the posts adjacent the outer side of the mounting block on each of the top and bottom sides of the mounting block and two of the posts adjacent the frame side of the mounting block on each of the top and bottom sides of the mounting block.

5. A valance kit and mounting assembly according to claim 1, wherein the mounting block further comprises a roller shade connector on the outer side thereof.

6. A valance kit and mounting assembly according to claim 5, wherein the plurality of shrouds comprises a top shroud positionable over a roller shade secured to the roller shade connector, the top shroud comprising a shade guide that is positioned to engage the roller shade.

7. A valance kit and mounting assembly according to claim 6, wherein the plurality of shrouds comprises side shrouds, and wherein the side shrouds comprise a shade track extending along a length dimension thereof that is sized to receive ends of the roller shade.

8. A valance kit and mounting assembly according to claim 1, wherein the plurality of shrouds comprises a top shroud, the top shroud comprising a cavity that is sized and configured to support a pleated shade or a mini-blind.

9. A valance kit and mounting assembly according to claim 8, wherein the plurality of shrouds further comprises side shrouds connected to the top shroud, and wherein the side shrouds comprise a shade track extending along a length dimension thereof that is sized to guide ends of the pleated shade or mini-blind.

* * * * *